United States Patent [19]

Johnson

[11] Patent Number: 5,065,458

[45] Date of Patent: Nov. 19, 1991

[54] APPEARANCE MODIFYING GARMENTS

[76] Inventor: Mary S. Johnson, Stripers Landing, Rte. 3, Unit 402, Moneta, Va. 24121

[21] Appl. No.: 592,972

[22] Filed: Oct. 4, 1990

[51] Int. Cl.[5] ..... A41D 5/00; A41B 11/00

[52] U.S. Cl. ..... 2/69; 2/67; 2/115; 2/239; 2/409

[58] Field of Search ..... 2/69, 67, 115, 239, 2/409; 428/919

[56] References Cited

U.S. PATENT DOCUMENTS

| | | | |
|---|---|---|---|
| 433,732 | 8/1890 | Horstmann | 2/79 |
| 1,817,053 | 2/1929 | Zerk | 2/239 |
| 4,282,609 | 8/1981 | Freedman et al. | 2/239 |
| 4,642,250 | 2/1987 | Spector | 2/115 |

OTHER PUBLICATIONS

"Mellow Mail", Catalog Reference; p. 7, Item F, and p. 2, Item A.

*Primary Examiner*—Werner H. Schroeder
*Assistant Examiner*—Gloria Hale
*Attorney, Agent, or Firm*—Shlesinger Arkwright & Garvey

[57] ABSTRACT

The appearance modifying garments include appearance enhancing color differences creating a new type of garment which promotes an improved appearance of the wearer through the formation of apparent marginal edges on the garment itself. The apparent marginal edges provide the outline of a shapely appearance and are formed by darkening areas of the garments so that they appear smaller or less noticeable to the eye when the garment is worn. The shapely portion stands out and the darker shaded portions are less noticeable and there is a distinct demarcation between the light area and the dark area so that the viewer's eye is drawn to the shapely portion of the garment.

4 Claims, 2 Drawing Sheets

FIGURE 2
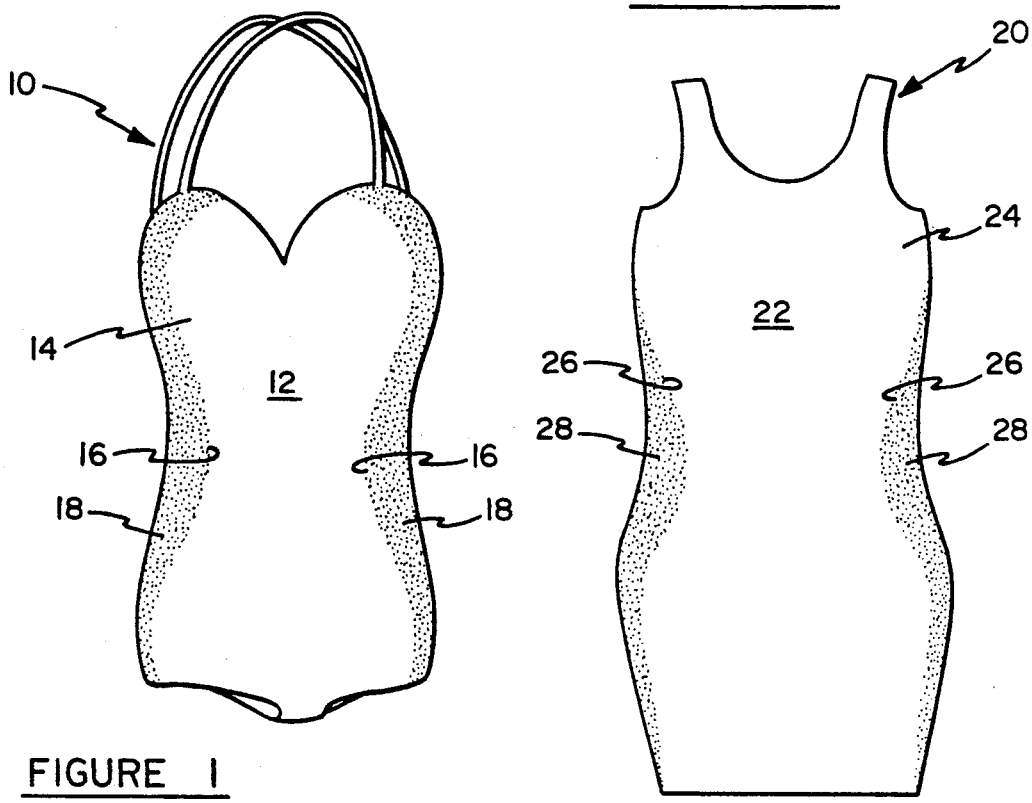
FIGURE 1
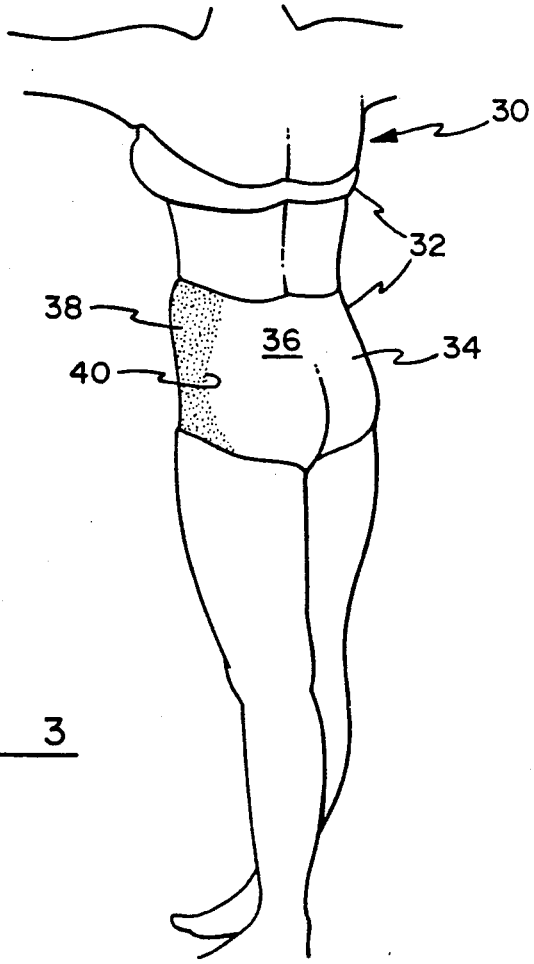
FIGURE 3

APPEARANCE MODIFYING GARMENTS

FIELD OF THE INVENTION

This invention relates to garments using shading in their color scheme to enhance the visual appearance of the wearer.

BACKGROUND OF THE INVENTION

In the field of wearing apparel, several devices have been utilized to enhance the wearer's appearance. Some appearance-enhancing devices have relied on the use of force to squeeze and shape body areas. These devices include corsets and girdles to shrink body areas. Other areas of the body have been given an enlarged appearance through the use of padding.

The use of colors or shades has been proven to be of great value in modifying a person's appearance. For example, horizontal stripes tend to make a person appear wider while vertical stripes tend to give the appearance of thinness.

The use of shading has been used to give an optical illusion by taking advantage of the eye's tendency to be drawn to lighter areas and ignore darker areas and thus the lighter areas appear larger and the darker areas appear smaller. U.S. Pat. No. 1,817,053 to Zerk uses shading to alter the appearance of a person's legs in the knee or ankle region by shading those areas darker, thereby making them appear smaller. In each embodiment of Zerk, the shaded area extends circumferentially around the leg.

U.S. Pat. No. 4,282,609 of Freedman discloses the use of gradations in shading. Each gradation circumscribes a central shaded portion. When it is desired to make a portion of a leg appear smaller, the central area is a higher intensity of a certain hue.

The invention herebelow described makes use of appearance enhancing color differences and applies them to create a new type of garment which promotes an improved appearance of the wearer through the formation of apparent marginal edges on the garment itself.

OBJECTS AND SUMMARY OF THE INVENTION

Accordingly, the present invention has been made to achieve the following objects:

An object of the invention is to provide a garment which enhances the visual appearance of its wearer.

Another object of the invention is to provide a garment which may be easily manufactured without extensive modification of existing equipment.

Yet another object of the invention is to provide close fitting apparel which can alter the appearance of the wearer from the front and from the back of the wearer.

Still another object of the invention is to provide an article of apparel which will alter the appearance of the wearer when the wearer is viewed from the side.

Still another object of the invention is that the garment is hosiery.

Yet another object of the invention is that the garment covers the upper torso of the wearer.

In summary, therefore, this invention is directed to an appearance enhancing garment having apparent marginal edges which provide the outline of a shapely appearance. The apparent marginal edges are formed by darkening areas of the garment so that they appear smaller or less noticeable to the eye so that when the garment is worn the shapely shaded portion stands out and darker shaded portions of the garment are less noticeable. The shapely shaded area extends continuously in the normally visible areas of the garment when it is worn. The invention is also directed to garments having darkened areas bordered by lighter areas and form the illusion of a more shapely body than truly exists.

These and other objects and advantages of the invention will be readily apparent in view of the following description and drawings of the above-identified invention.

BRIEF DESCRIPTION OF THE DRAWINGS

The above and other objects and advantages and novel features of the present invention will be readily apparent from the following detailed description of the invention illustrated in the accompanying drawings, wherein:

FIG. 1 is a front plan view of a garment having appearance enhancing shaded areas;

FIG. 2 is a perspective view of a dress having appearance enhancing marginal edges;

FIG. 3 is a perspective view of a person wearing a bathing suit having a bottom portion showing the appearance enhancing effect;

DETAILED DESCRIPTION OF THE INVENTION

Figures 4, 5, 6, 7, 8:
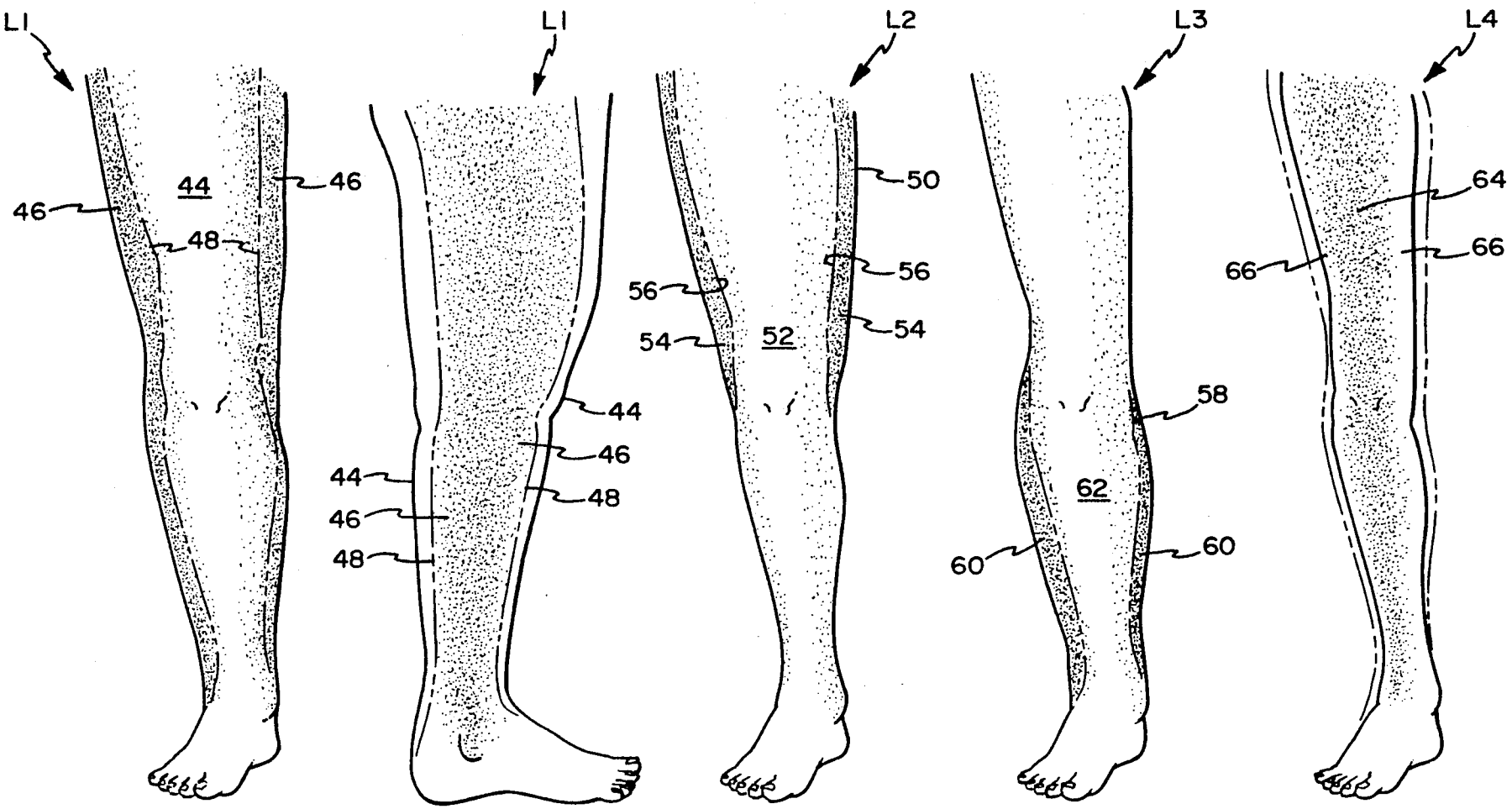
FIGS. 4, 6 and 7 illustrate the use of apparent marginal edges in hosiery to provide a shapely leg appearance.
FIG. 5 shows a side view of the leg of FIG. 4.
FIG. 8 is a front view of a garment having apparent marginal edges to add shape to a thin, relatively shapeless leg.

Referring now to the drawings and more particularly to FIG. 1, a bathing suit 10 is shown having a central area 12 depicting a desired body shape. Preferably, a central area 12 appears on both the back (not shown) and the front 14 of the bathing suit 10. Apparent marginal edges 16 form the outline of the central area and define the outline of the preferred body shape.

The apparent marginal edges 16 do not form a distinct line, but form a distinct color change between light and dark whereby the lighter color or hue is in the central portion 12 and the darker shade is outside the apparent marginal edge 16 forming a shaded area 18 of the bathing suit 10.

The central area 12 and the shaded portion 18 may be different shades of the same color where the shaded portion 18 is darker than the central area 12, or the differences may be more abrupt such as a white central area 12 and a black shaded portion 18.

In the appearance-enhancing garment, the difference between the central area 12 and the shaded area 18 is not a gradual change but a distinct demarcation defining an apparent marginal edge 16 in the bathing suit 10 so that a viewer's eye is drawn to the central area 12 and is distracted from the shaded area 18.

FIG. 2 illustrates a form fitting dress 20 having a central area 22 of a front portion 24 defined by apparent marginal edges 26. It should be pointed out that the lines defining the apparent marginal edges 26 are merely illustrative in the figure and would only be denoted by the change in shade or color in the actual garment to define the boundary of the shaded area 28 to form the apparent marginal edge 26.

FIG. 3 illustrates a female form 30 wearing a two-piece bathing suit 32. The bottom portion 34 includes a central area 36 and a shaded portion 38. Where the central area 36 and the shaded portion 38 meet, an apparent marginal edge 40 is formed. The apparent marginal edge 40 gives the optical illusion that the female form 30 has a more shapely bottom than is actually the case.

FIGS. 4–8 show four embodiments of the invention incorporated into stockings or hosiery. In FIG. 4, a form-fitting stocking 42 is placed over a leg L1. Stocking 42 has imprinted thereon a lighter area 44 depicting a shapely leg straddled by a shaded portion 46. The lighter area 44 and shaded portions 46 are imprinted on the stocking 42, compensating for stretching which will occur as the stocking 42 is placed over the leg L1. For example, a stocking or hose 42 are commonly much smaller when not being worn, and the lighter area 44 and darker area 46 will stretch proportionally. The stocking 42 could also be created with lighter area 44 and shaded portions 46 by weaving lighter and darker materials.

FIG. 5 is a side view of the leg L1 wearing the stocking 42 showing the shaded portion 46 straddled by front and back lighter areas 44 at apparent marginal edges 48.

FIG. 6 illustrates a leg L2 having a shapely calf and ankle. In order to give the thigh area 50 of the leg L2 a shapely appearance, a lighter central shapely portion 52 is bounded by a darker gradually shaded portion 54 thereby forming apparent marginal edges 56 and making the lighter shapely portion 52 stand out.

FIG. 7 shows a leg L3 having a shapely thigh and knee area, but having a calf area 58 which is not proportional to the thigh and knee. The use of darker shaded portions 60 and a lighter central portion 62 provides the optical illusion of a proportional leg by forming apparent marginal edges 64.

FIG. 8 is an example of an opposite illusory effect which occurs when the darker shade is applied to the central portion 64 of a leg L4 and lighter areas 66 bound the shaded areas 64 to give a wider look to a leg and add shape to a thin leg.

It is an important aspect of the invention to provide an appearance from the front or the back of the leg rather than from the side. The shapely appearance is most effective when the wearer of the garment is viewed from the front or the rear as when they are walking toward or away from the viewer.

It should also be understood that the examples shown in the drawing figures are not the only possible locations for use of the appearance enhancing garment, but the appearance enhancing features could be applied only at the knees, for example or at the ankles or at only the upper torso.

Typical materials used in the manufacture of garments having the above-described appearance modifying characteristics would generally include to some degree an elastic feature similar to that found in hosiery and elastic-containing clothing. However, tight-fitting clothing such as jeans could also incorporate the figure-enhancing features.

While this invention has been described as having an appearance modifying garment it is understood that it is capable of further modifications, uses and/or adaptations of the invention following in general the principle of the invention and including such departures from the present disclosure as come within known or customary practice in the art to which the invention pertains, and as may be applied to the central features hereinbefore set forth, and fall within the scope of the invention and the limits of the appended claims. This principle can be done with very suttle shading (especially in hosiery) to very dramatic shading! This principal can be used in dresses (short or long) skirts (short or long) tights, body suits - stockings and hosiery - bathing suits (one or two piece) and shorts!!

I claim:

1. A garment for providing an enhanced appearance to the wearer, the garment comprising:
   a) an article of form-fitting clothing for conforming to a wearer's body shape;
   b) said article having a central shaded area bounded by marginal shaded areas on either side of said central area when said article is viewed from front and back, said central shaded area contrasting with said marginal shaded areas by light and dark shades;
   c) said marginal and said central areas when viewed from front and back having distinct lines of demarcation between dark and light shades; and,
   d) whereby said distinct line of demarcation between said light and dark shades causes the viewer's eye to be drawn to said central shaded area.

2. The garment as defined in claim 1, wherein:
   a) said article of clothing is constructed of elastic material for conforming to the wearer's body shape.

3. The garment as defined in claim 1, wherein:
   a) said light shade is centrally located between said apparent marginal edges when the article of clothing is viewed from the front or the rear.

4. The garment as defined in claim 3, wherein:
   a) said dark shade is centrally located between said apparent marginal edges when said article of clothing is viewed from the side.

* * * * *